US010914515B2

(12) United States Patent
Deisley et al.

(10) Patent No.: US 10,914,515 B2
(45) Date of Patent: Feb. 9, 2021

(54) BEVERAGE COOLING APPARATUS AND METHOD

(71) Applicants: Brian Scott Deisley, New Braunfels, TX (US); Dylan Deisley, New Braunfels, TX (US)

(72) Inventors: Brian Scott Deisley, New Braunfels, TX (US); Dylan Deisley, New Braunfels, TX (US)

( * ) Notice: Subject to any disclaimer, the term of this patent is extended or adjusted under 35 U.S.C. 154(b) by 194 days.

(21) Appl. No.: 16/260,002

(22) Filed: Jan. 28, 2019

(65) Prior Publication Data

US 2020/0240704 A1 Jul. 30, 2020

(51) Int. Cl.

| | |
|---|---|
| ***F25D 31/00*** | (2006.01) |
| *F25D 17/02* | (2006.01) |
| *F25D 11/00* | (2006.01) |

(52) U.S. Cl.

CPC ..... *F25D 31/002* (2013.01); *F25D 31/007* (2013.01); *F25D 11/003* (2013.01); *F25D 17/02* (2013.01)

(58) Field of Classification Search

CPC ..... F25D 31/002; F25D 31/007; F25D 17/02; F25D 11/003; F25D 3/08; F25D 2331/805; F25D 2331/809

See application file for complete search history.

(56) References Cited

U.S. PATENT DOCUMENTS

| | | | | |
|---|---|---|---|---|
| 3,049,890 A * | 8/1962 | Ruppel | A23B 4/066 62/64 |
| 3,888,092 A * | 6/1975 | Fisher | F25D 17/02 62/376 |
| 5,191,773 A * | 3/1993 | Cassell | F25D 17/02 62/342 |
| 8,516,849 B2 * | 8/2013 | Mooijer | F25D 16/00 62/457.5 |
| 2009/0056369 A1 * | 3/2009 | Fink | F25D 17/02 62/457.4 |
| 2018/0080706 A1 * | 3/2018 | Mize | F25D 31/007 |

* cited by examiner

*Primary Examiner* — Joseph F Trpisovsky
(74) *Attorney, Agent, or Firm* — Darryl Edwin Scott

(57) ABSTRACT

A container enclosing a volume, the container having a container floor facing the volume, a release valve, and a detachable lid positioned opposite the container floor. The detachable lid having at least one lid inlet that penetrates the detachable lid. The lid inlet having an inlet sleeve having a first sleeve end that extends outside the detachable lid and a second sleeve end that extends into the container. A conduit system having at least one overflow outlet fluidly coupled to the conduit system and positioned within the second sleeve end and a water pump coupled to the conduit system for transferring a fluid through the conduit system.

16 Claims, 9 Drawing Sheets

BEVERAGE COOLING APPARATUS AND METHOD

BACKGROUND

Changing the temperature of a beverage for personal consumption is commonly practiced. For example, tea may be mixed with heated water for personal consumption. Conversely, beverages may be kept in refrigeration systems until they are removed for consumption. However, once the beverage is removed from the cooling or heating source, the beverage begins to adjust its temperature to that of the atmospheric temperature. The preferred temperature for the beverage may rapidly change once the beverage is removed from the cooling or heating source. Maintaining a constant beverage temperature during any rate of consumption is a challenge.

DETAILED DESCRIPTION

Figure 2:
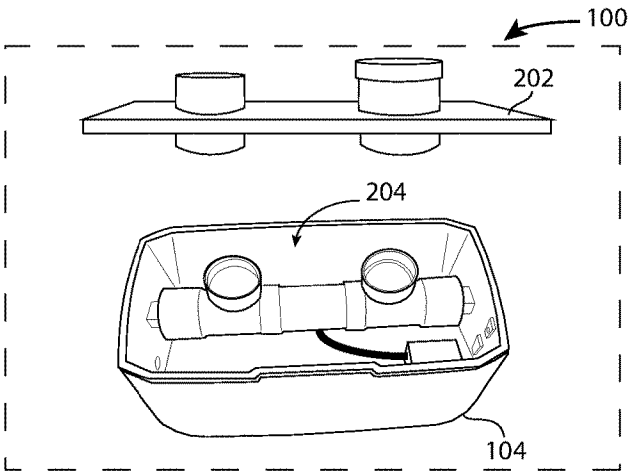
FIG. 2 is a perspective view of a beverage cooling unit with a detachable lid enclosing a conduit system and a water pump.

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Changing the temperature of a beverage for personal consumption is commonly practiced. For example, herbs may be mixed with heated water to make tea. However, immediately after the tea is removed from the heating source, the tea's temperature begins to change to match the atmospheric temperature. The rate at which the beverage's temperature changes may differ for each environment; nonetheless the beverage's temperature will invariably change. Thus, the beverage's initial temperature (i.e., first sip) will not be the same as the beverage's final temperature (i.e., last sip), unless the person quickly consumes the entire beverage, which can be dangerous and not ideal.

Conversely, beverages may be kept in refrigeration systems until they are removed for personal consumption. Again, once the beverage is removed from the cooling source, the beverage's temperature begins to change to match the atmospheric temperature.

Maintaining a preferred drinking temperature becomes problematic if the surrounding atmospheric temperature does not match the temperature of the beverage. A person would need to quickly consume the entire beverage to enjoy the drink at the preferred temperature. Quickly consuming a beverage can be dangerous, especially if the beverage is large (e.g., greater than 30 ounces) or contains alcohol. Further, inserting a beverage into a bucket of ice can be inconvenient and challenging. For example, it is challenging to insert an open container into a bucket of ice such that it stays in a stationary position to keep the beverage from spilling over. A person will not be able quickly consume a portion of their beverage and easily insert their drink back into the bucket of ice. The embodiments described herein allows the use of water that is continually cooled by ice to cool the beverage.

In addition, the embodiments described herein also describes the apparatus and method of maintaining a beverage's temperature during any rate of personal consumption. The rate of consuming a beverage may vary from person to person; however, the rate at which the beverage's temperature changes will be minimal. The embodiments described herein allows a person to consume a beverage at any desirable rate while the beverage maintains a temperature of between 32 degrees to 45 degrees Fahrenheit (i.e. 0 degrees Celsius to 7.22 degrees Celsius).

Figure 1:
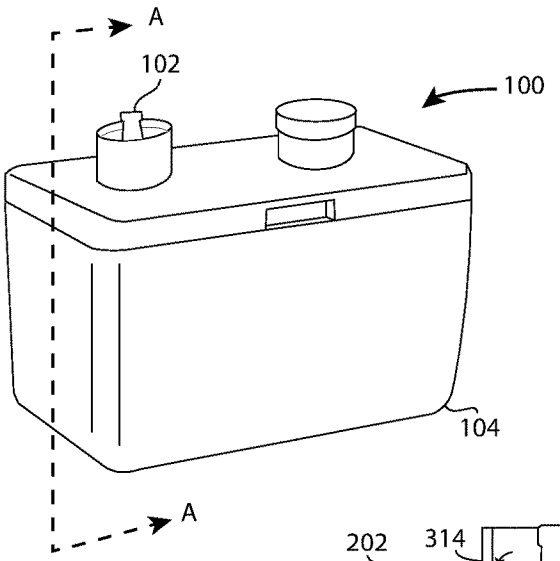
FIG. 1 is perspective view of a beverage cooling unit.

FIG. 1 is perspective view of a beverage cooling unit. As illustrated in FIG. 1, a cooling unit 100 is the apparatus by which the temperature of a beverage 102 is adjusted. The beverage 102 may be any beverage, including water bottles, beer bottles, soda cans, wine bottles, etc. In one or more embodiments, the cooling unit 100 includes a container 104. The container 104 may be adjusted to accommodate a larger beverage such as a 30-liter bottle or a 15.5-gal keg of beer or alternatively, a smaller beverage such as a "shot" glass. The container 104 may be manufactured with a Polymer® material provided by Polymer Rotomolding Company Limited (i.e., plastic), or a metal material, or a combination of both.

FIG. 2 is a perspective view of a beverage cooling unit with a detachable lid enclosing a conduit system and a water pump. The container 104 may include a detachable lid 202. The detachable lid 202 may be made from the same material as the container 104 (i.e., Polymer® provided by Polymer Rotomolding Company Limited, metal, or a combination of both). The detachable lid 202 may be coupled to the container 104 by hinges (not shown) such that the detachable lid 202 is partially detached from the container 104 and rotates about the hinges to expose the interior of the container 104. The detachable lid 202 may be coupled to the container 104 by snapping locks (not shown) such that the detachable lid 202 can be fully removed from the container 104 to expose the interior of the container 104. As illustrated in FIG. 2, a volume 204 is exposed when the detachable lid 202 is removed from the container 104. That is, the container 104 encloses the volume 204 which houses the elements to adjust the temperature of the beverage 102.

Figure 3:
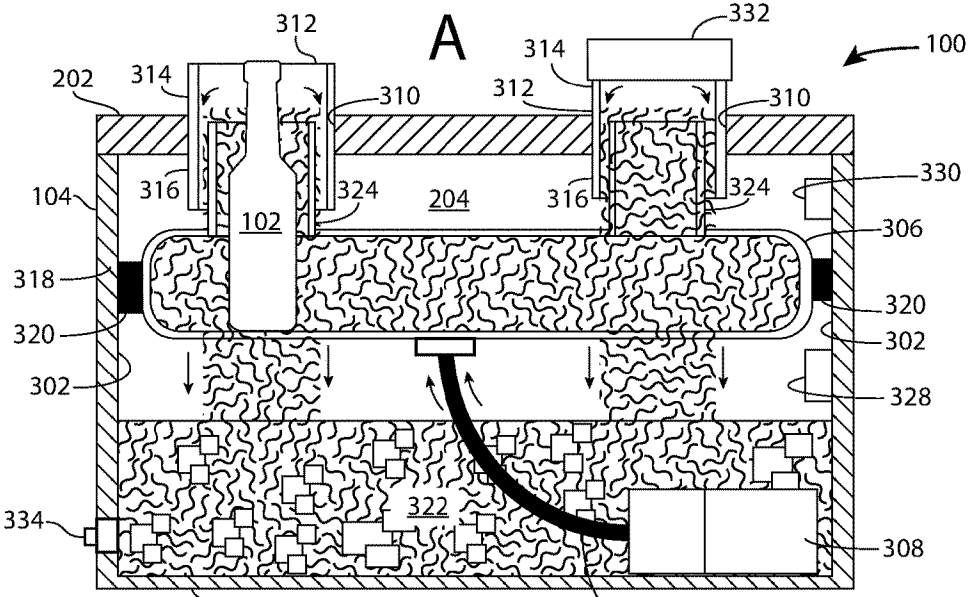
FIG. 3 is a cross-sectional view of FIG. 1 showing the beverage cooling unit, a conduit system, and a water pump.

FIG. 3 is a cross-sectional view of FIG. 1 showing the beverage cooling unit, a conduit system, and a water pump. As illustrated in FIG. 3, the container 104 encloses the volume 204. The volume 204 is the open space that houses the elements of the container 104. In one or more embodiments, the container 104 includes container walls 302, a container floor 304, a conduit system 306, and a water pump 308. Note, the container 104 has four walls. The remaining two walls are not referenced in FIG. 3 for clarity. Alternately, the shape of the container 104 may be cylindrical, hexagonal, or may take the form of any ornamental shape that is capable of enclosing a volume (e.g., globe, pyramid). Further, the size of the container 104 may come in several dimensions suitable for mobile transportation and/or stationary installation. The term "mobile" is defined herein as having the ability to be transferred by a motor vehicle, a dolly, or physically carried by an individual. Further, the water pump 308 may be submersible, thus having the ability to operate under water.

Further, as illustrated in FIG. 3, the detachable lid 202 is positioned opposite the container floor 304. Here, the detachable lid 202 is illustrated as attached to the container 104 (i.e., attached to the container walls 302). In one or more embodiments, the detachable lid 202 may include a lid inlet 310 that penetrates the detachable lid 202 creating a hole to access the volume 204 of the container 104. Note, although FIGS. 1-3 shows two lid inlets, it is not to be interpreted as having only two lid inlets, but the detachable lid 202 may have a single lid inlet or multiple lid inlets penetrating the detachable lid 202. In one or more embodiments, the detachable lid 202 includes an inlet sleeve 312 coupled to the lid inlet 310 such that a first sleeve end 314 extends outside the detachable lid 202 (i.e., in a direction away from the volume 204) and a second sleeve end 316 that extends into the container 104 and into the volume 204.

In one or more embodiments, the container 104 is insulated (i.e., lined within the casing of the container wall 302, the detachable lid 202, and the container floor 304) with a temperature control material 318 (illustrated as the cross-hatching in the container walls 302, the container floor 304, and the detachable lid 202). The temperature control material 318 may be made from material such as Styrofoam® provided by Dow Chemical Company or any other similar material. The temperature control material 318 may be made from other insulated material such as fiberglass, mineral wood, cellulose, polyurethane foam, or other similar material. The temperature control material 318 controls the rate at which the internal temperature of the container 104 adjusts to match the atmospheric temperature.

As described above, the container 104 may include the conduit system 306. The conduit system 306 may be mounted to the container 104 using mounting brackets 320. In one or more embodiments, the conduit system 306 may not be mounted to the container 104 but may be placed on the container floor 304. In another embodiment, the conduit system 306 may also be molded to the container 104. The conduit system 306 is used to transfer a fluid 322 to reduce the temperature of the beverage 102 to a preferred temperature for consumption. The conduit system 306 may include a series of pipes fluidly connected or may include a single pipe system. The conduit system 306 may be made from the same material as made by the container 104. Further, the conduit system 306 may be insulated with the same temperature control material 318 as used in the container 104. In one or more embodiments, the conduit system 306 includes an overflow outlet 324. The overflow outlet 324 may be fluidly coupled to the conduit system 306. Further, the overflow outlet 324 is aligned and positioned within the second sleeve end 316 (i.e., the overflow outlet 324 is enveloped by the second sleeve end 316). In one or more embodiments, the fluid 322 travels from the conduit system 306 into the overflow outlet 324 and drains back into the container 104. The beverage 102 can be inserted into the overflow outlet 324 so that the fluid 322 can adjust the temperature of the beverage 102. In another embodiment, the beverage 102 is mounted (not shown) to the overflow outlet 324 by beverage holders (not shown).

In one or more embodiments, a mixture of ice and water is used as the fluid 322 to adjust the temperature of the beverage 102. The fluid 322 may be deposited into the container 104 by opening the detachable lid 202 and inserting the fluid 322. When the fluid 322 is deposited into the container 104, the water pump 308 is activated to begin transferring the fluid 322 through the conduit system 306 and into the overflow outlet 324 to reduce the temperature of the beverage 102. The water pump 308 may have a minimum output of 1/200 horsepower and a maximum output of one horsepower.

A person (not shown) will be able to remove the beverage 102 from the overflow outlet 324, consume some of the contents of the beverage 102, and reinsert the beverage 102 into the overflow outlet 324 to maintain the temperature of the beverage 102. Additionally, the person (not shown) will be able to consume the beverage 102 at any desired rate of consumption.

In one or more embodiments, the water pump 308 is coupled to the conduit system 306. In another embodiment, the water pump 308 is coupled to the conduit system 306 with a hose 326 or some other similar attachment. A temperature gauge 328 may be coupled or placed within the container 104 to monitor the temperature of the fluid 322. The temperature reading of the temperature gauge 328 may be visually observed by a person or remotely observed by a mobile app (not shown) programmed to read the temperature gauge 328. Further, the temperature gauge 328 can be programmed to alert the person when the temperature of the fluid 322 falls below or above a restricted temperature range.

In one or more embodiments, the container 104 includes a fluid level alert monitor 330 to monitor the fluid level in the container 104. The fluid level alert monitor 330 may be programmed to alert the user if the fluid level falls below or above a desired level.

In one or more embodiments, the container 104 may be sealed with a removable cap 332 coupled to the first sleeve end 314. Placing the removable cap 332 on the first sleeve end 314 will keep debris from entering the beverage 102 and the interior of the container 104. Further, the container 104 may include a release valve 334 for releasing the fluid 322 from the interior of the container 104. The release valve 334 may be installed on the container wall 302 or the container floor 304. The release valve 334 may also be removed so that a hose (not shown) can be inserted into the container 104 to pump out the fluid 322.

Figure 4:
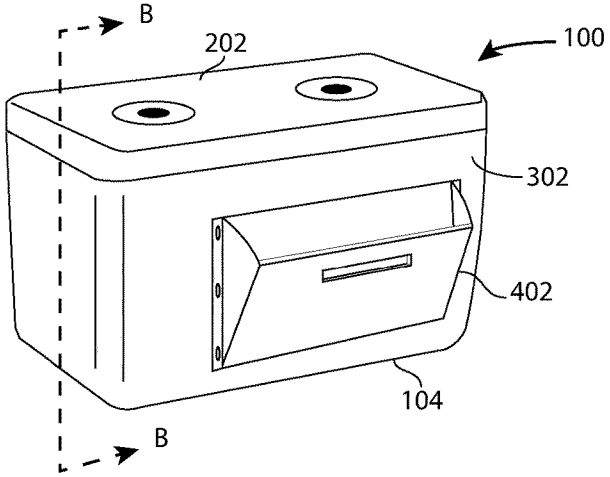
FIG. 4 is a perspective view of a beverage cooling unit with a deposit box.

The container 104 may be designed in different variations. For example, FIG. 4 is a perspective view of a beverage container unit with a deposit box. Similar to the container 104 described in connection with FIGS. 1-3, the container 104 in FIG. 4 may be also manufactured with a Polymer® material provided by Polymer Rotomolding Company Limited (i.e., plastic), a metal material, or a combination of both. As illustrated in FIG. 4, the container 104 may include a deposit box 402. In addition to the detachable lid 202 described in connection with FIGS. 1-3, the container 104 described in connection to FIGS. 4-6 may also include the deposit box 402 for depositing the mixture of ice and water (i.e., fluid 322 (not shown in FIG. 4)). The deposit box 402 may be installed on the container wall 302 and mounted by hinges (not shown for clarity) to allow the person to open and close the deposit box 402. The deposit box 402 may also be installed on the detachable lid 202 (not shown). The container 104, the detachable lid 202, and the deposit box 402 may all be made from the same material (i.e., Polymer® provided by Polymer Rotomolding Company Limited, metal, or a combination of both).

Figure 5:
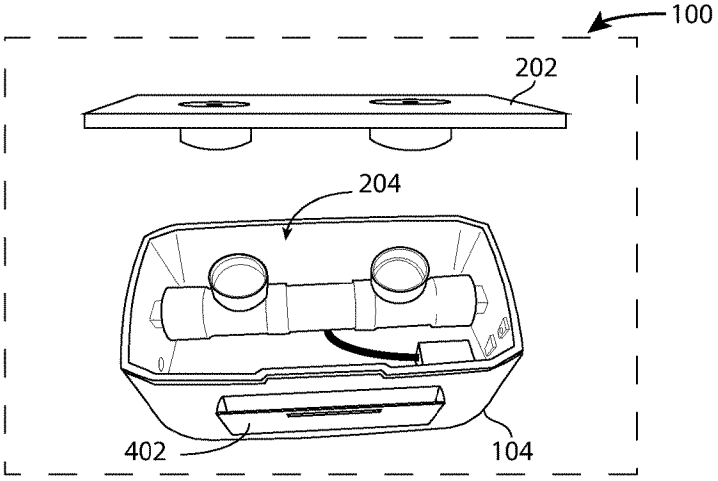
FIG. 5 is a perspective view of a beverage cooling unit with a detachable lid and a deposit box enclosing a conduit system and a water pump.

FIG. 5 is a perspective view of a beverage cooling unit with a detachable lid and a deposit box enclosing a conduit system and a water pump. As previously described, container 104 may include the detachable lid 202. The detachable lid 202 may be coupled to the container 104 by hinges (not shown) such that the detachable lid 202 is partially detached from the container 104 and rotates about the hinges to expose the interior of the container 104. The detachable lid 202 may be coupled to the container 104 by snapping locks (not shown) such that the detachable lid 202 can be fully removed from the container 104 to expose the interior of the container 104. As illustrated in FIG. 5, the volume 204 is exposed when the detachable lid 202 is removed from the container 104. That is, the container 104 encloses the volume 204 which houses the elements that adjust the temperature of the beverage 102 (not illustrated in FIG. 5, but illustrated in FIG. 6).

Figure 6:
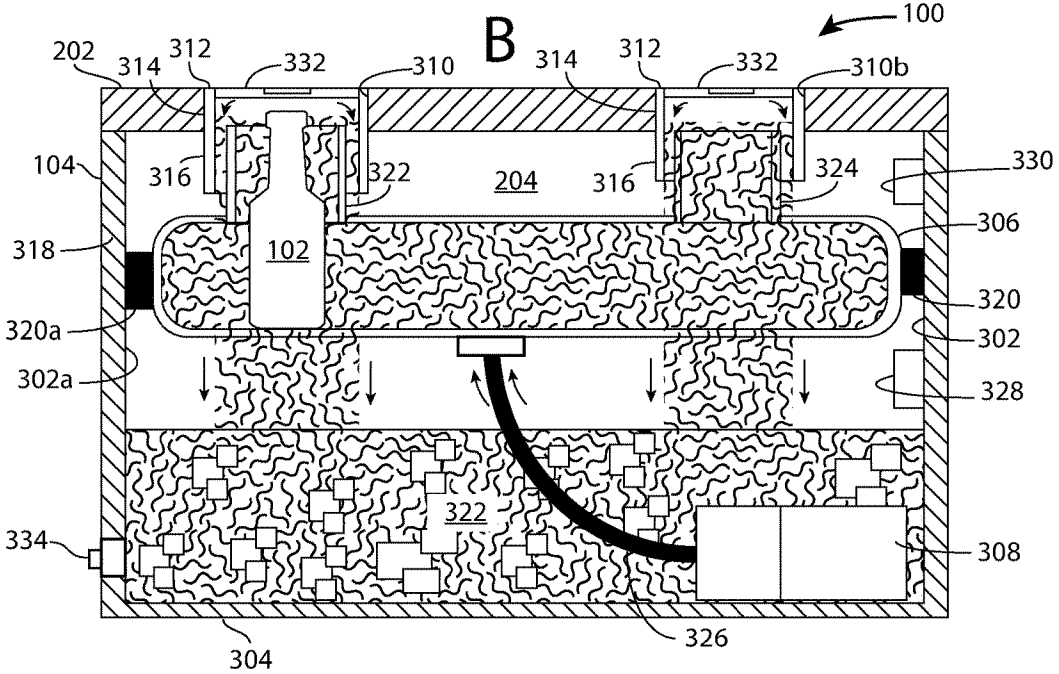
FIG. 6 is a cross-sectional view of FIG. 4 showing the beverage cooling unit, a conduit system, and a water pump.

FIG. 6 is a cross-sectional view of FIG. 4 showing the beverage cooling unit, a conduit system, and a water pump. As illustrated in FIG. 6, the container 104 encloses the volume 204. The volume 204 is surrounded by the elements of the container 104, which includes the container walls 302, the container floor 304, and the detachable lid 202. In addition, the volume 204 houses the elements in the container 104 which includes the conduit system 306 and the water pump 308. Note, the container 104 has four walls. The remaining two walls are not referenced in FIG. 6 for clarity. Alternately, the shape of the container 104 may be cylindrical, hexagonal or may take the form of any ornamental shape that is capable of enclosing a volume (e.g., globe, pyramid). Further, the size of the container 104 may come in several dimensions suitable for mobile transportation and/or stationary installation. Further, the water pump 308 may be submersible, thus having the ability to operate under water.

Further, as illustrated in FIG. 6, the detachable lid 202 is positioned opposite the container floor 304. Here, the detachable lid 202 is illustrated as attached to the container 104 (i.e., attached to the container walls 302). In one or more embodiments, the detachable lid 202 may include the lid inlet 310 that penetrates the detachable lid 202 creating a hole to access the volume 204 of the container 104. Note, although FIGS. 4-6 shows two lid inlets 310, it is not to be interpreted as having only two lid inlets, but the detachable lid 202 may have a single lid inlet or multiple lid inlets penetrating the detachable lid 202. In one or more embodiments, the detachable lid 202 includes the inlet sleeve 312 coupled to the lid inlet 310 such that the first sleeve end 314 is coupled to the detachable lid 202 and the second sleeve end 316 that extends into the container 104 and into the volume 204.

Similar to the container 104 described in connections with FIGS. 1-3, the container 104 described in connection with FIGS. 4-6 is also insulated (i.e., lined within the casing of the container wall 302, the detachable lid 202, and the container floor 304) with the temperature control material 318 (illustrated as the cross-hatching in the container walls 302, the container floor 304, and the detachable lid 202). The temperature control material 318 may be made from material such as Styrofoam® provided by Dow Chemical Company or any other similar material. The temperature control material 318 may be made from other insulated material such as fiberglass, mineral wood, cellulose, polyurethane foam, or other similar material.

Further, as illustrated in FIGS. 4-6, the container 104 may include the conduit system 306. The conduit system 306 may be mounted in the container 104 using mounting brackets 320. In one or more embodiments, the conduit system 306 may not be mounted to the container 104 but may be placed on the container floor 304. In another embodiment, the conduit system 306 may also be molded to the container 104. The conduit system 306 is used to transfer the fluid 322 (i.e., water) to reduce the temperature of the beverage 102 (illustrated in FIG. 6) to a preferred temperature for consumption. The conduit system 306 may include a series of pipes fluidly connected or may include a single pipe system. The conduit system 306 may be made from the same material as made by the container 104 described in connection with FIGS. 1-3. Further, the conduit system 306 may be insulated with the same temperature control material 318 as used in the container 104. In one or more embodiments, the conduit system 306 includes the overflow outlet 324. The overflow outlet 324 is fluidly coupled to the conduit system 306. Further, the overflow outlet 324 is aligned and positioned within the second sleeve end 316 (i.e., the overflow outlet 324 is enveloped by the second sleeve end 316). The fluid 322 travels from the conduit system 306 and into the overflow outlet 324 and falls back into the volume 204 of the container 104. The beverage 102 is inserted into the overflow outlet 324 to adjust the temperature of the beverage 102. In another embodiment, the beverage 102 is mounted (not shown) to the overflow outlet 324 to adjust the temperature of the beverage 102.

As illustrated in FIG. 6, the mixture of ice and water is used as the fluid 322 to cool the beverage 102. The fluid 322 may be deposited into the container 104 by opening the detachable lid 202 and inserting the fluid 322. In another embodiment, the fluid 322 may be deposited into the container 104 by opening the deposit door 402 and inserting the mixture of ice and water into the container 104. When the fluid 322 is deposited into the container 104, the water pump 308 is activated to begin transferring the fluid 322 through the conduit system 306 and into the overflow outlet 324 to adjust the temperature of the beverage 102. The water pump 308 may have a minimum output of 1/200 horsepower and a maximum output of one horsepower.

In one or more embodiments, the water pump 308 is directly fluidly coupled to the conduit system 306. In another embodiment, the water pump 308 is fluidly coupled to the conduit system 306 by the hose 326 or some other similar conduit. The temperature gauge 328 may be coupled or placed within the container 104 to monitor the temperature of the fluid 322. The reading of the temperature gauge 328 may be visually observed by the person or accessed remotely by a mobile app (not shown). Further, the temperature gauge 328 can be programmed to alert the person when the temperature of the fluid 322 falls below or above a specified temperature.

In one or more embodiments, the container 104 includes a fluid level alert monitor 330 to monitor the fluid level of the container 104. The fluid level alert monitor 330 may be programmed to alert the user if the fluid 322 falls below or above a desired level.

As further illustrated in FIG. 6, the container 104 may be sealed with a removable cap 332 coupled to the first sleeve end 314. Placing the removable cap 332 on the first sleeve end 314 will keep debris from entering the beverage 102 and the interior of the container 104. As illustrated in FIGS. 4-6, the removable cap 332 is flushed with the detachable lid 202 so that other objects may be stacked on top of the container 104 for ease of transport. Further, the container 104 may include the release valve 334 for releasing the fluid 322 from the interior of the container 104. The release valve 334 may be installed on the container wall 302 or the container floor 304. The release valve 334 may also be removed so that a hose (not shown) can be inserted into the container 104 to pump out the fluid 322.

Figure 8:
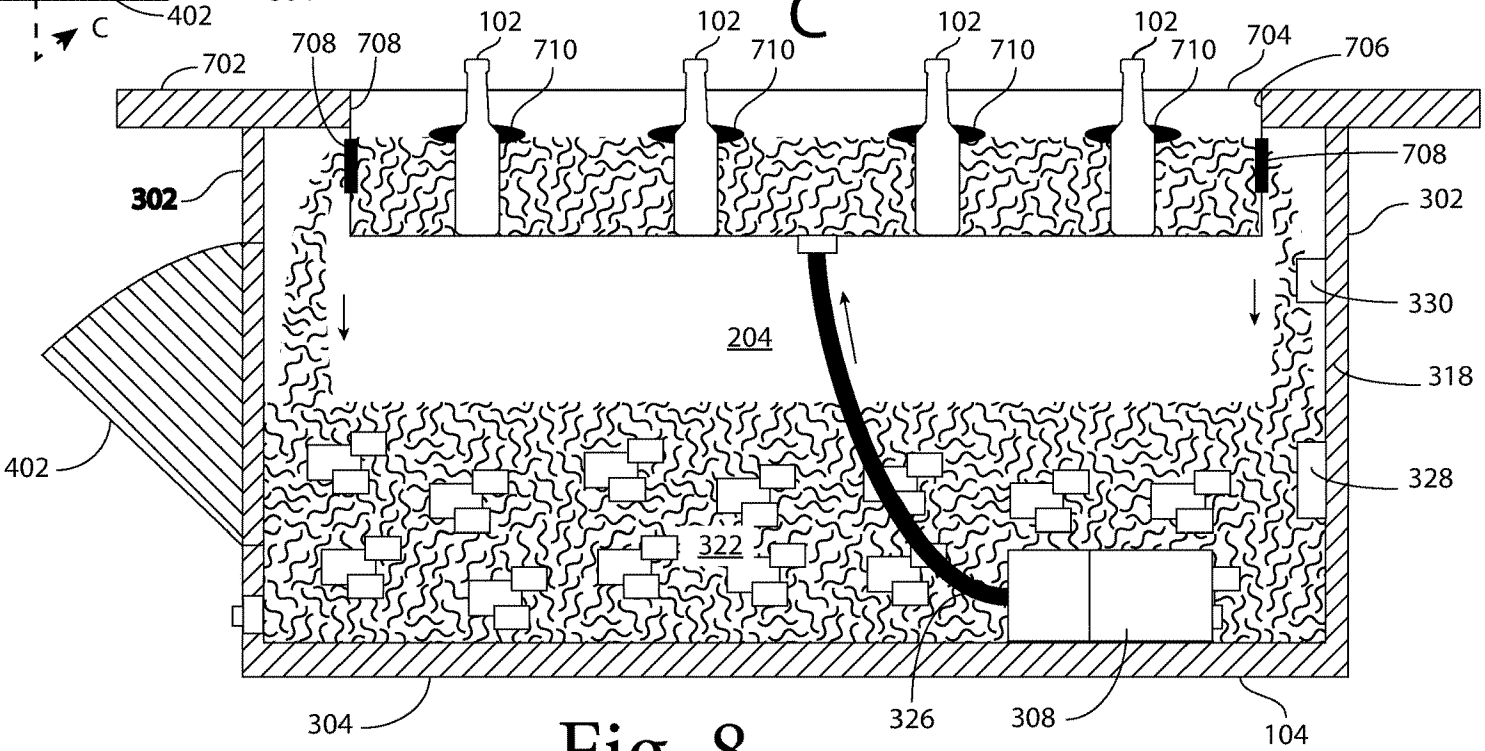
FIG. 8 is a cross-sectional view of FIG. 7 showing the beverage cooling unit, the trough, the deposit door, and beverage mounts.
Figure 7:
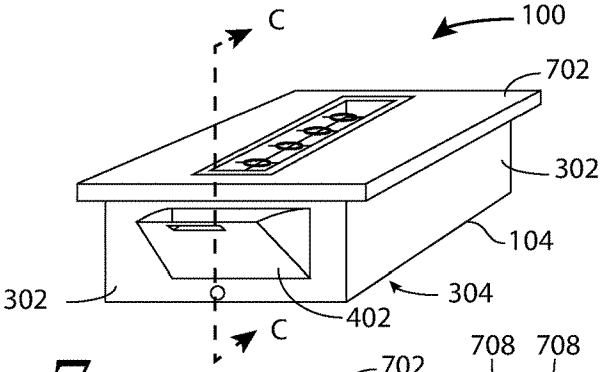
FIG. 7 is a perspective view of a beverage cooling unit with a trough and a deposit door.

As illustrated in FIGS. 7-8, the beverage cooling unit 100 may be designed differently. For example, FIG. 7 is a perspective view of a beverage cooling unit with a trough and a deposit door. In one or more embodiments, the container 104 has a container roof 702 which acts as a table top for people to gather around. The container roof 702 is positioned opposite the container floor 304. The dimensions of the container 104 and the container roof 702 may be manufactured in different sizes that would be suitable for mobile transportation and/or stationary installation.

Similar to the container 104 described in connection to FIGS. 1-6, the container 104 in FIG. 7 may also be manufactured with a Polymer® material provided by Polymer Rotomolding Company Limited (i.e., plastic), or a metal material, or a combination of both. As illustrated in FIG. 7, the container 104 may include the deposit box 402. In one or more embodiments, the deposit box 402 is used for depositing the mixture of ice and water (i.e., fluid 322). The deposit box 402 may be installed on the container wall 302 and mounted by hinges (not shown for clarity) to allow the person to open and close the deposit box 402. The deposit box 402 may also be installed on the detachable lid 202 (not shown). The container 104, the container roof 702, and the deposit box 402 may all be made from the same material (i.e., Polymer® provided by Polymer Rotomolding Company Limited, metal, or a combination of both). In addition, the container roof 702 may be manufactured with wood.

FIG. 8 is a cross-sectional view of FIG. 7 showing the beverage cooling unit, the trough, the deposit door, and the beverage mounts. As illustrated in FIG. 8, the container 104 encloses the volume 204. The volume 204 is enclosed by the elements of the container 104, which includes the container walls 302, the container floor 304 that faces the volume 204, and the container roof 702 positioned opposite the container floor 304. In addition, the volume 204 houses the elements in the container 104 which includes a portion of the trough 704 and the water pump 308. Note, the container 104 has four walls. The remaining two walls are not referenced in FIG. 8 for clarity. Further, the size of the container 104 may come in several dimensions suitable for mobile transportation and/or stationary installation.

Further, as illustrated in FIG. 8, the container roof 702 includes a container roof inlet 706 that penetrates the container roof 702 creating an opening to access the volume 204 of the container 104. The trough 704 may be coupled to and secured to the container roof inlet 706. In one or more embodiments, the trough 704 may include trough outlets 708 to allow the fluid 322 to exit the trough 704 and reenter the volume 204 and fall to the container floor 304 to be repumped by the water pump 308. In another embodiment, the trough 708 may include a secondary trough (not shown) positioned below the trough 708 to capture any fluid 322 overflow from the trough 704. The overflow fluid 322 will fall back into the container 104 to be repumped by the water pump 308. Note, the water pump 308 may be submersible, thus having the ability to operate under water.

In one or more embodiments, the container 104 is insulated (i.e., lined within the casing of the container wall 302, the container roof 702, and the container floor 304) with the temperature control material 318 (illustrated as the cross-hatching in the container walls 302, the container floor 304, and the container roof 702). The temperature control material 318 may be made from such material as Styrofoam provided by Dow Chemical Company or any other similar material. The temperature control material may be made with other insulated material such as fiberglass, mineral wood, cellulose, polyurethane foam, or other similar material. The temperature control material 318 controls the rate at which the internal temperature of the container 104 adjusts to match the atmospheric temperature. Further, the trough 704 may be made from the same material as made by the container 104. Further, the trough 704 may be insulated with the same temperature control material 318 as used in the container 104. In one or more embodiments, the trough 704 includes at least one beverage mount 710 to hold the beverage 102 while the temperature of beverage 102 is being adjusted by the fluid 322. Note, although FIG. 8 illustrates a specific number of beverage mounts 710, this is not to be interpreted as only having a limited number of beverage mounts 710 but may include more or less beverage mounts 710 than shown.

As illustrated in FIG. 8, the mixture of ice and water is used as the fluid 322 to adjust the temperature of the beverage 102. The fluid 322 may be deposited into the container 104 by opening the container roof 702 and inserting the fluid 322. In another embodiment, the fluid 322 may be deposited into the container 104 by opening the deposit door 402 and inserting the mixture of ice and water into the container 104. When the fluid 322 is deposited into the container 104, the water pump 308 is activated to begin transferring the fluid 322 through the trough 704 to cool the beverage 102. The water pump 308 may have a minimum output of 1/200 horsepower and a maximum output of one horsepower. Further, the container 104 may include the release valve 334 for releasing the fluid 322 from the interior of the container 104. The release valve 334 may be installed on the container wall 302 or the container floor 304. The release valve 334 may also be removed so that a hose (not shown) can be inserted into the container 104 to pump out the fluid 322.

In one or more embodiments, the water pump 308 is directly fluidly coupled to the trough 704. In another embodiment, the water pump 308 is fluidly coupled to the trough 704 with the hose 326 or some other similar attachment. The temperature gauge 328 may be coupled or placed within the container 104 to monitor the temperature of the fluid 322. The reading of the temperature gauge 328 may be visually observed by the person or accessed remotely by a mobile app (not shown). Further, the temperature gauge 328 can be programmed to alert the person when the temperature of the fluid 322 falls below or above a specified temperature.

In one or more embodiments, the container 104 includes a fluid level alert monitor 330 to monitor the fluid level of the container 104. The fluid level alert monitor 330 may be programmed to alert the user if the fluid 322 falls below or above a desired level. In addition, the mobile app (not shown) may integrate and monitor both the temperature gauge 328 and fluid level alert monitor 330.

Figure 9:
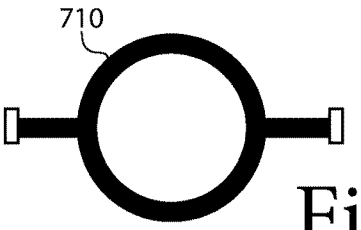
FIG. 9 is an aerial view of a beverage mount.

FIG. 9 is an aerial view of a beverage mount. The beverage mount 710 may be made from a polymer material with elastic properties to secure the beverage 102 to the trough 704. The beverage mount 710 may also be made from a metal material. Further, the beverage mount 710 may be manufactured in varying sizes in diameter to compensate for different types of beverages. Further, the beverage mount 710 may be scalable (e.g., having the ability to expand and contract to accommodate a range of sizes). In one or more embodiments, the beverage mount 710 is detachable.

Figure 10:
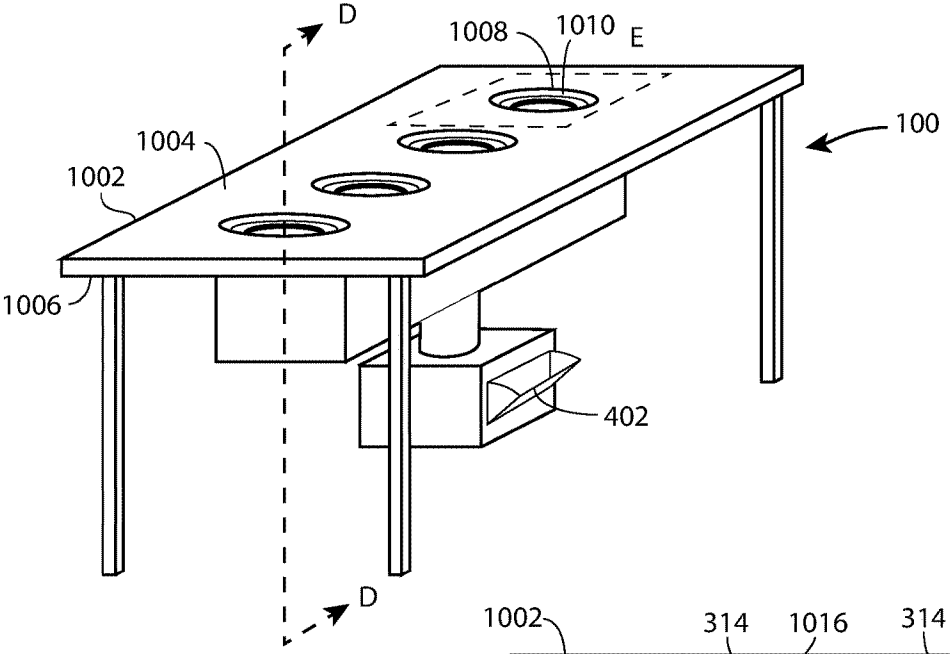
FIG. 10 is a perspective view of a beverage cooling surface, a conduit system, and a container with a deposit box.

In another variation of the cooling unit 100, the conduit system 306 is directly connected to a surface. For example, FIG. 10 is a perspective view of a beverage cooling surface, a conduit system, and a container with a deposit box. As illustrated, the beverage cooling unit 100 may include a surface 1002 (e.g., a table top or bar surface). The surface 1002 may include a surface top 1004 and a surface bottom 1006. The surface 1002 may be used to allow patrons to gather around and consume their beverage (not shown in FIGS. 10-12). The surface 1002 may be manufactured from wood, plastic, metal, stone, concrete or other similar material. In one more or embodiments, the surface 1002 includes at least one bore 1008 that penetrates through the surface 1002 (i.e., through the surface top 1004 and the surface bottom 1006). Note, although FIG. 10 shows a limited number of bores 1008, this is not to be interpreted as to only have a limited number of bores but may include a greater or fewer number of bores 1008 than shown. The bores 1008 creates bore walls 1010 in the surface 1002. As described below, the conduit system 306 is coupled to the bore walls 1010.

Figure 11:
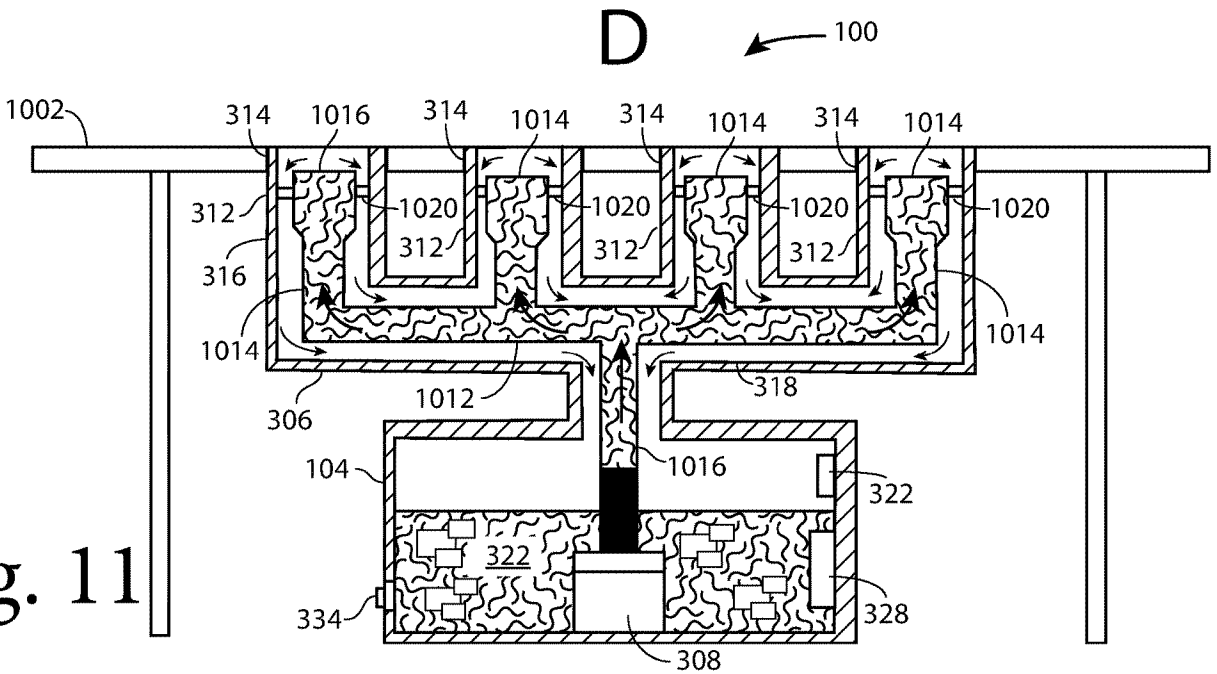
FIG. 11 is a cross-sectional view of FIG. 10 showing the beverage cooling surface, the conduit system, the container with the deposit box, an internal conduit system, and a water pump.

FIG. 11 is a cross-sectional view of FIG. 10 showing the beverage cooling surface, the conduit system, the container with the deposit box, an internal conduit system, and a water pump. In one or more embodiments, the beverage cooling unit 100 includes the conduit system 306. The conduit system 306 may include a series of pipes fluidly connected or may include a single pipe system. The conduit system 306 may be made from the same material as made by the container 104 described in connection to FIGS. 1-9. Further, the conduit system 306 may be insulated with the same temperature control material 318 used in the container 104 described in connection with FIGS. 1-9.

The conduit system 306 may include the inlet sleeve 312. The inlet sleeve 312 may be coupled to the surface 1002. In one or more embodiments, the inlet sleeve 312 includes the first sleeve end 314 coupled to the bore walls 1010 and a second sleeve end 316 fluidly coupled to the conduit system 306. In one or more embodiments, the conduit system 306 is coupled to the container 104. The container 104 may also include the deposit box 402 (not illustrated in FIG. 11 but illustrated in FIG. 10) for depositing the mixture of ice and water (i.e., fluid 322). The deposit box 402 may be installed on the container wall 302 and mounted by hinges (not shown for clarity) to allow the person to open and close the deposit box 402. The container 104 and the deposit box 402 may all be made from the same material (i.e., Polymer® provided by Polymer Rotomolding Company Limited, metal, or a combination of both).

As further illustrated in FIG. 11, the container 104 may include the water pump 308. The water pump 308 may be fluidly coupled to an internal conduit 1012. In one or more embodiments, the internal conduit 1012 is contained in the conduit system 306. The internal conduit 1012 may include a first end 1014 coupled to a beverage holder 1016 and a second end 1018 coupled to the water pump 308. Note, the water pump 308 may be submersible, thus having the ability to operate under water. In one or more embodiments, the container 104 and the conduit system 306 is insulated with the same temperature control material 318 described in connection with FIGS. 1-9.

As illustrated in FIG. 11, when the water pump 308 is activated, the fluid 322 (i.e., mixture of ice and water) is pumped into the internal conduit 1012 (indicated by the arrows) and travels to the beverage holder 1016. The fluid 322 overflows and filters through an overflow vent 1020 that is coupled to the beverage holder 1016 and the first sleeve end 314. The fluid 322 travels back through the conduit system 306 (indicated by the arrows) and redeposits back into the container 104 where the water pump 308 repumps the fluid 322 into the internal conduit 1012. The water pump 308 may have a minimum output of 1/200 horsepower and a maximum output of one horsepower.

Further, the container 104 may include the release valve 334 for releasing the fluid 322 from the interior of the container 104. The release valve 334 may be installed on the container wall 302 or the container floor 304. The release valve 334 may also be removed so that a hose (not shown) can be inserted into the container 104 to pump out the fluid 322.

As further illustrated in FIG. 11, the temperature gauge 328 may be coupled or placed within the container 104 to monitor the temperature of the fluid 322. The reading of the temperature gauge 328 may be visually observed by the person or accessed remotely by a mobile app (not shown). Further, the temperature gauge 328 can be programmed to alert the person when the temperature of the fluid 322 falls below or above a specified temperature. In one or more embodiments, the container 104 includes the fluid level alert monitor 330 to monitor the fluid level of the container 104. The fluid level alert monitor 330 may be programmed to alert the user if the fluid 322 falls below or above a desired level.

Figure 12:
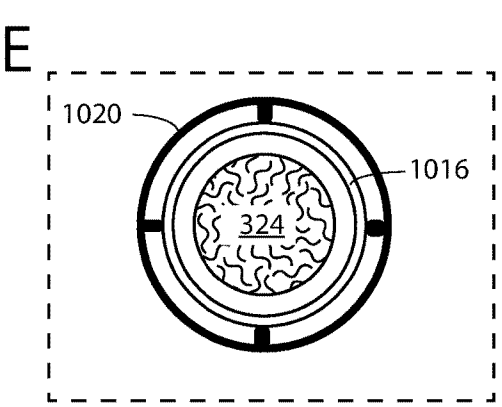
FIG. 12 is an aerial view of a beverage holder having an overflow vent.

FIG. 12 is an aerial view of a beverage holder having an overflow vent. As previously described in connection to FIG. 11, the beverage holder 1016 may include overflow vents 1020 to allow the fluid 322 to flow back into the conduit system 306. Further, the overflow vents 1020 may include mesh filtering (not shown) or other similar material to restrict debris or other objects from entering the conduit system 306.

Figure 13:
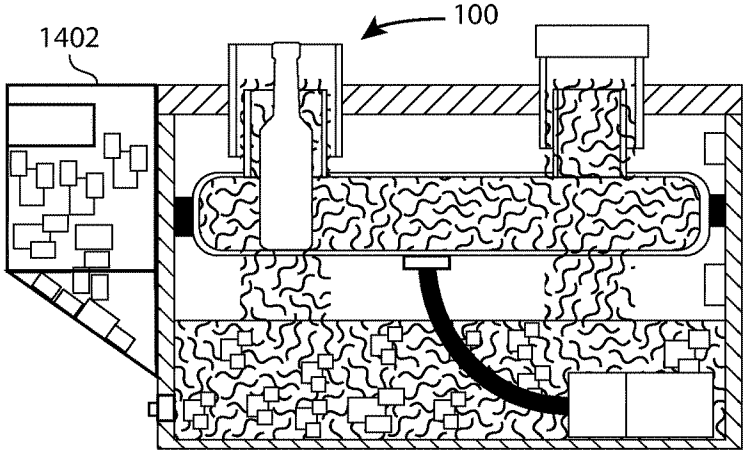
FIG. 13 is a cross-sectional view of a beverage cooling unit coupled to an icemaker, a conduit system, and a water pump.

Depositing the ice into the container 104 may also be an automated process. For example, FIGS. 13-16 are cross-sectional views of an icemaker coupled to a beverage cooling unit. Specifically, FIG. 13 is a cross-sectional view of a beverage cooling unit coupled to an icemaker, a conduit system, and a water pump. The beverage cooling unit 100 illustrated in FIG. 13 is the same as the beverage cooling unit 100 described in connection to FIGS. 1-3, except in addition includes an automated icemaker 1402 coupled to the container 104. The automatic icemaker 1402 is coupled to the container 104 such that the icemaker 1402 can directly deposit ice into the container 104.

Figure 14:
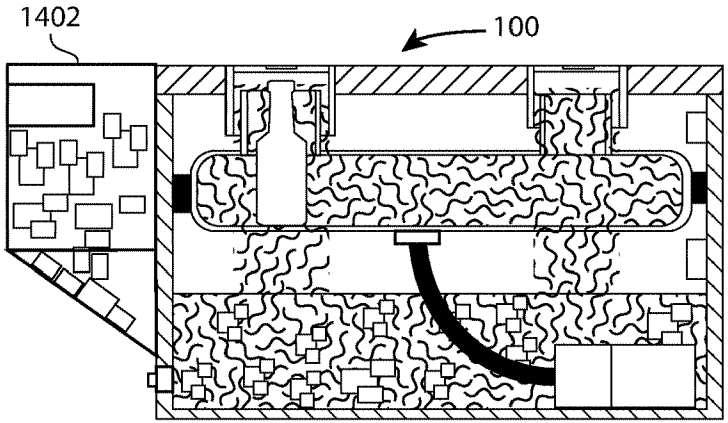
FIG. 14 is a cross-sectional view of an alternate beverage cooling unit coupled to an icemaker, a conduit system, and a water pump.

FIG. 14 is a cross-sectional view of an alternate beverage cooling unit coupled to an icemaker, a conduit system, and a water pump. The beverage cooling unit 100 illustrated in FIG. 14 is the same as the beverage cooling unit 100 described in connection to FIGS. 4-6, except in addition includes an automated icemaker 1402 coupled to the container 104. The automatic icemaker 1402 is coupled to the container 104 such that the icemaker 1402 can directly deposit ice into the container 104.

Figure 15:
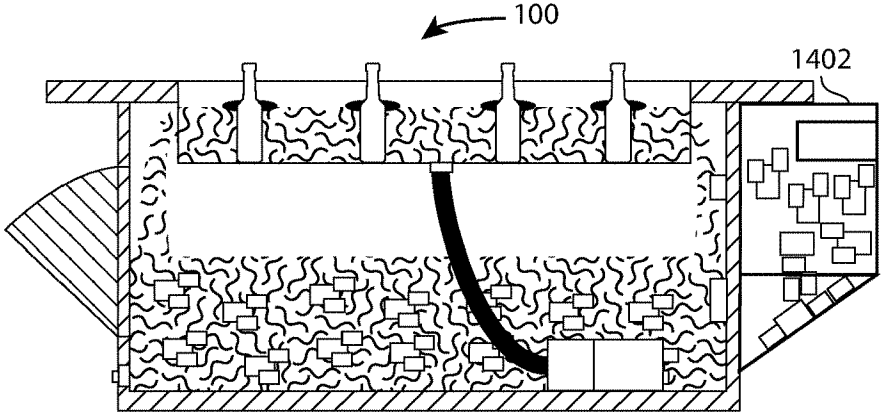
FIG. 15 is a cross-sectional view of a beverage cooling unit with a trough, a deposit door, an icemaker, and a water pump.

FIG. 15 is a cross-sectional view of a beverage cooling unit with a trough, a deposit door, an icemaker, and a water pump. The beverage cooling unit 100 illustrated in FIG. 15 is the same as the beverage cooling unit described in connection to FIGS. 7-8, except in addition includes an automated icemaker 1402 coupled to the container 104. The automatic icemaker 1402 is coupled to the container 104 such that the icemaker 1402 can directly deposit ice into the container 104.

Figure 16:
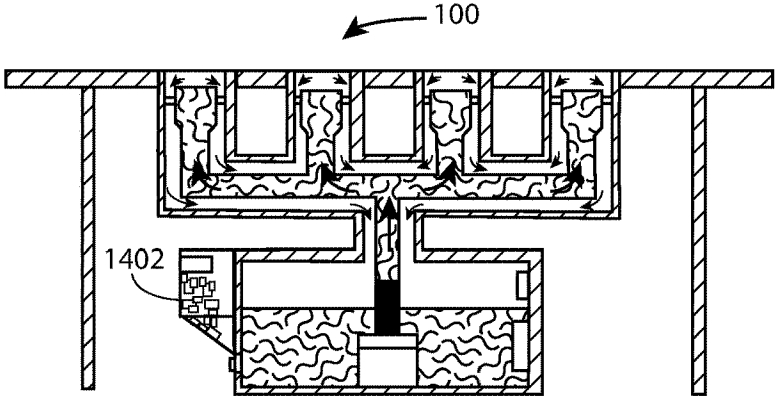
FIG. 16 is a cross-sectional view of a beverage cooling surface, a conduit system, an internal conduit system, and an icemaker coupled to a container having a water pump.

FIG. 16 is a cross-sectional view of a beverage cooling surface, a conduit system, an internal conduit system, and an icemaker coupled to a container having a water pump. The beverage cooling unit 100 illustrated in FIG. 16 is the same as the beverage cooling unit 100 described in connection to FIGS. 10-11, except in addition includes an automated icemaker 1402 coupled to the container 104. The automatic icemaker 1402 is coupled to the container 104 such that the icemaker 1402 can directly deposit ice into the container 104.

Figure 17:
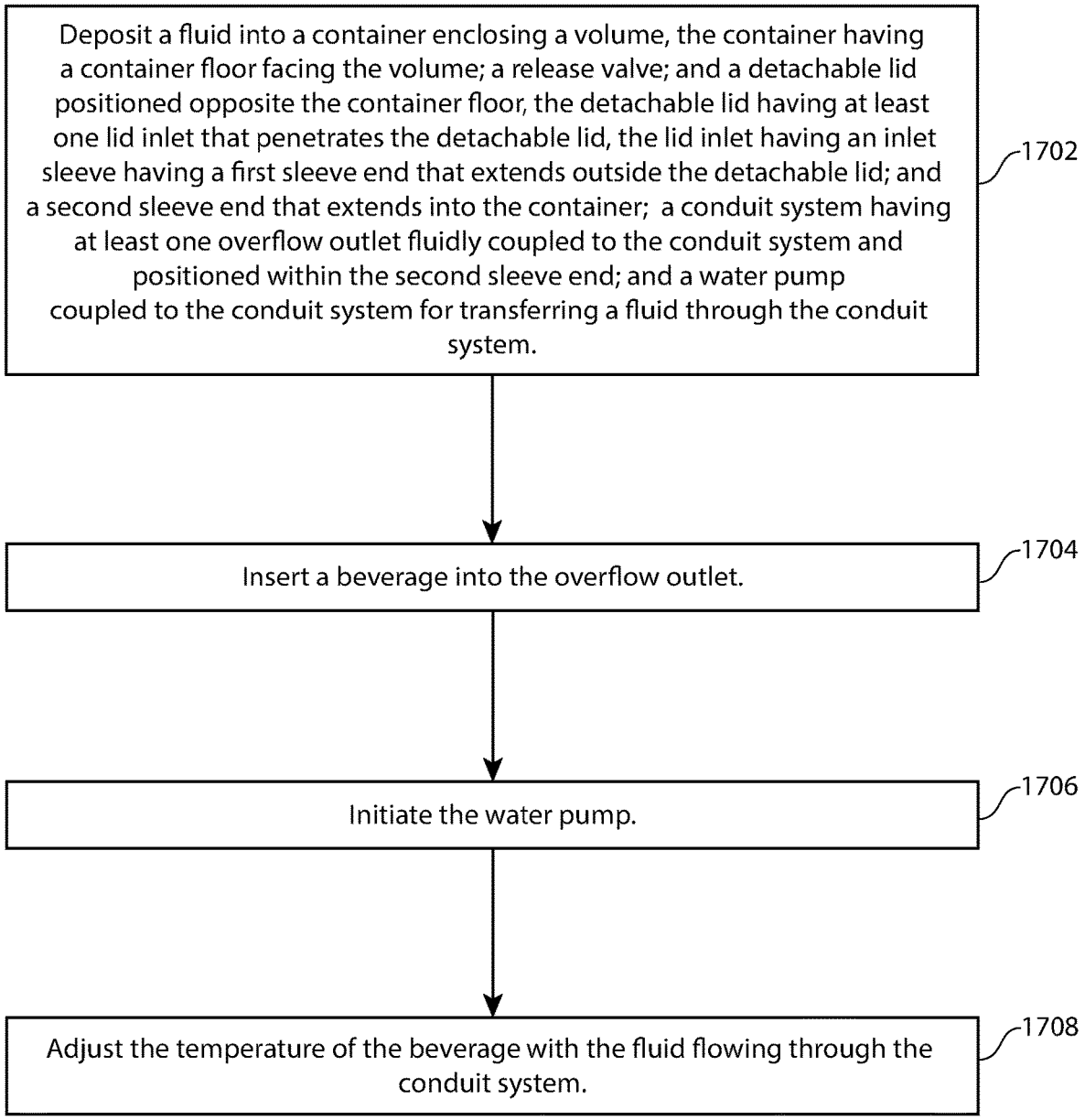
FIG. 17 is a flow chart of the method of cooling a beverage using the beverage cooling unit.

FIG. 17 is a flow chart of the method of cooling a beverage using the beverage cooling unit. The process includes depositing a fluid (such as fluid 322) into a container (such as container 104) enclosing a volume (such as volume 204), the container (such as container 104) having a container floor (such as container floor 304) facing the volume (such as volume 204), release valve (such as release valve 334), and a detachable lid (such as detachable lid 202) positioned opposite the container floor (such as container floor 304), the detachable lid (such as detachable lid 202) having at least one lid inlet (such as lid inlet 310) that penetrates the detachable lid (such as detachable lid 202), the lid inlet (such as lid inlet 310) having an inlet sleeve (such as inlet sleeve 312) having a first sleeve end (such as first sleeve end 314) that extends outside the detachable lid (such as detachable lid 202); and a second sleeve end (such as second sleeve end 316) that extends into the container (such as container 104); a conduit system (such as conduit system 306) having at least one overflow outlet (such as overflow outlet 324) fluidly coupled to the conduit system and (such as conduit system 306) positioned within the second sleeve end (such as second sleeve end 316); and a water pump (such as water pump 308) coupled to the conduit system (such as conduit system 306) for transferring a fluid (such as fluid 322) through the conduit system (such as conduit system 306) (block 1702). Inserting a beverage (such as beverage 102) into the overflow outlet (such as overflow outlet 324) (block 1704). Initiating the water pump (such as water pump 308) (block 1706). Adjusting the temperature of the beverage (such as beverage 102) with the fluid (such as fluid 322) through the conduit system (such as conduit system 306) (block 1708).

Figure 18:
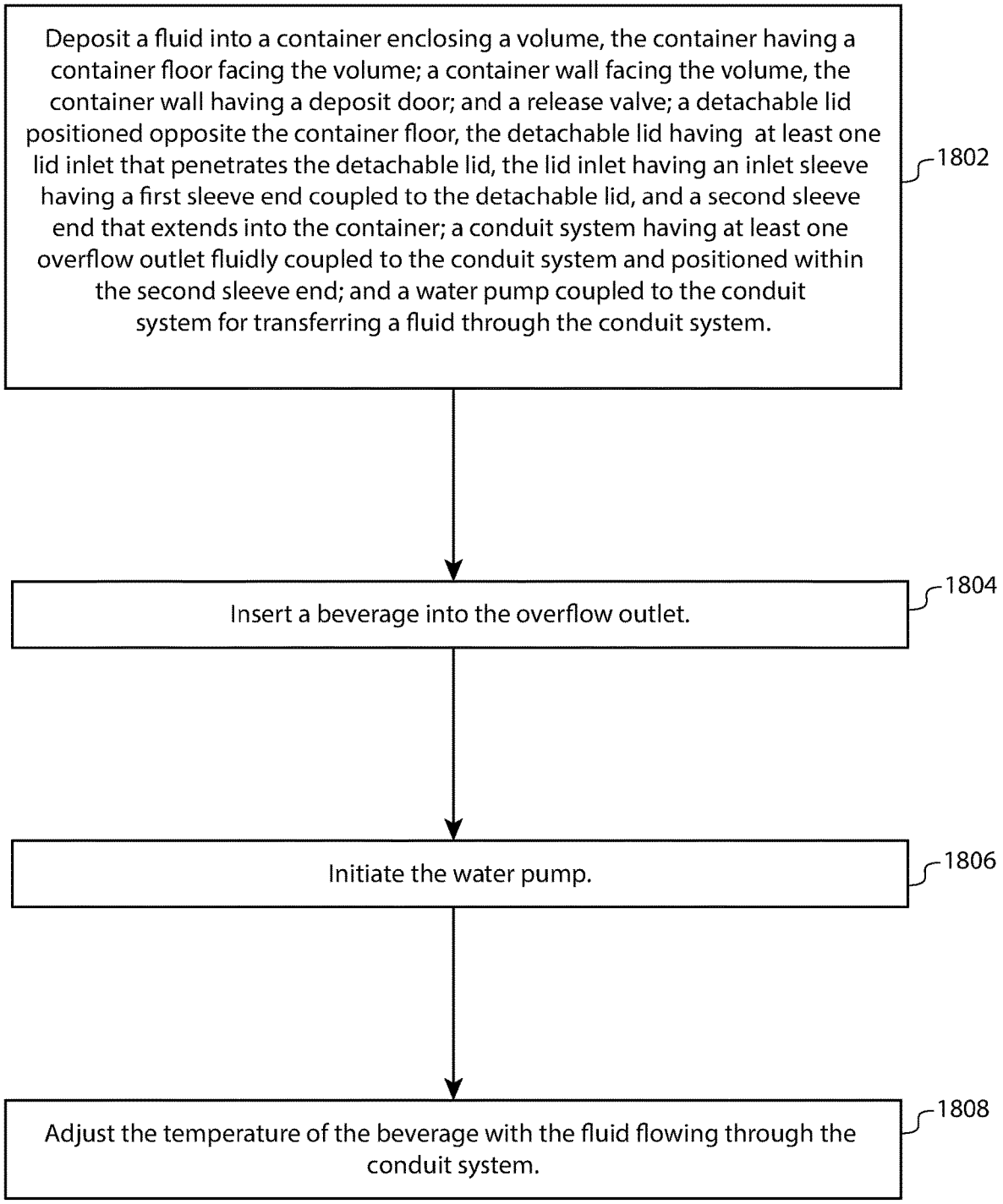
FIG. 18 is a flow chart of the method of cooling a beverage using an alternate beverage cooling unit.

FIG. 18 is a flow chart of the method of cooling a beverage using an alternative beverage cooling unit. The process includes depositing a fluid (such as fluid 322) into a container (such as container 104) enclosing a volume (such as volume 204), the container (such as container 104) having a container floor (such as container floor 304) facing the volume (such as volume 204); a container wall (such as container wall 302) facing the volume (such as volume 204), the container wall (such as container wall 302) having a deposit door (such as deposit door 402); and a release valve (such as release valve 334); a detachable lid (such as detachable lid 202) positioned opposite the container floor (such as container floor 304), the detachable lid (such as detachable lid 202) having at least one lid inlet (such as lid inlet 310) that penetrates the detachable lid (such as detachable lid 202), the lid inlet (such as lid inlet 310) having an inlet sleeve (such as inlet sleeve 312) having a first sleeve end (such as first sleeve end 314) coupled to the detachable lid (such as detachable lid 202), and a second sleeve end (such as second sleeve end 316) that extends into the container (such as container 104); a conduit system (such as conduit system 306) having at least one overflow outlet (such as overflow outlet 324) fluidly coupled to the conduit system (such as conduit system 306) and positioned within the second sleeve end (such as second sleeve end 316); and a water pump (such as water pump 308) coupled to the conduit system (such as conduit system 306) for transferring a fluid (such as fluid 322) through the conduit system (such as conduit system 306) (block 1802). Inserting a beverage (such as beverage 102) into the overflow outlet (such as overflow outlet 324) (block 1804). Initiating the water pump (such as water pump 308) (block 1806). Adjusting the temperature of the beverage (such as beverage 102) with the fluid (such as fluid 322) through the conduit system (such as conduit system 306) (block 1808).

Figure 19:
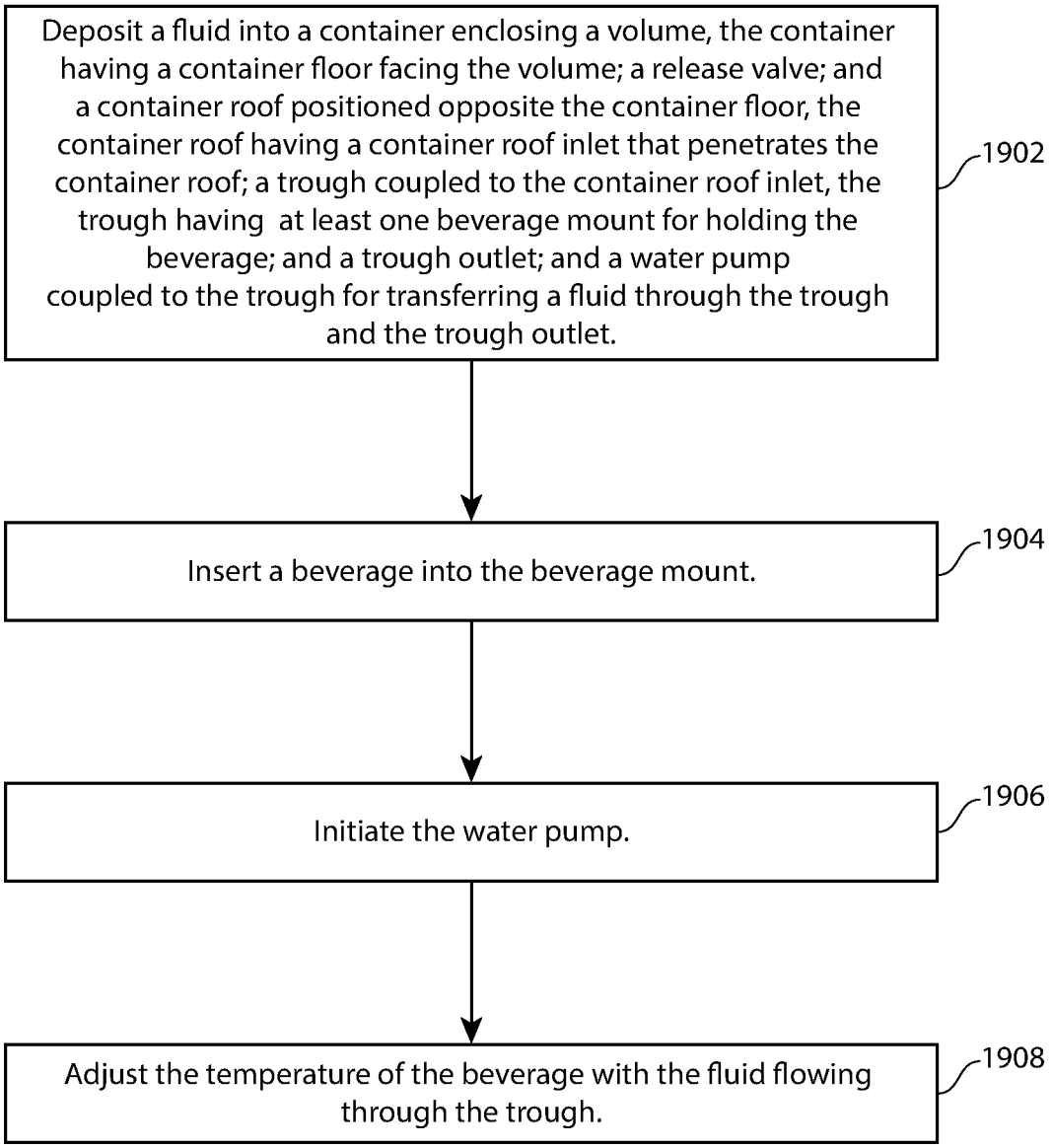
FIG. 19 is a flow chart of the method of cooling a beverage using a trough system.

FIG. 19 is a flow chart of the method of cooling a beverage using a trough system. The process includes depositing a fluid (such as fluid 322) into a container (such as container 104) enclosing a volume (such as volume 204), the container (container 104) having a container floor (such as container floor 304) facing the volume (such as volume 204); a release valve (such as release valve 334); and a container roof (such as container roof 702) positioned opposite the container floor (such as container floor 304), the container roof (such as container roof 702) having a container roof inlet (such as container roof inlet 706) that penetrates the container roof (container roof 702); a trough (such as trough 704) coupled to the container roof inlet (such as container roof inlet 706), the trough (such as trough 704) having at least one beverage mount (such as beverage mount 710) for holding the beverage (such as beverage 102); and a trough outlet (such as trough outlet 708); and a water pump (such as water pump 308) coupled to the trough (such as trough 704) for transferring a fluid (such as fluid 322) through the trough (such as trough 704) and the trough outlet (such as trough outlet 708) (block 1902). Inserting a beverage (such as beverage 102) into the beverage mount (such as beverage mount 710) (block 1904). Initiating the water pump (such as water pump 308) (block 1906). Adjusting the temperature of the beverage (such as beverage 102) with the fluid (such as fluid 322) flowing through the trough (such as trough 704) (block 1908).

Figure 20:
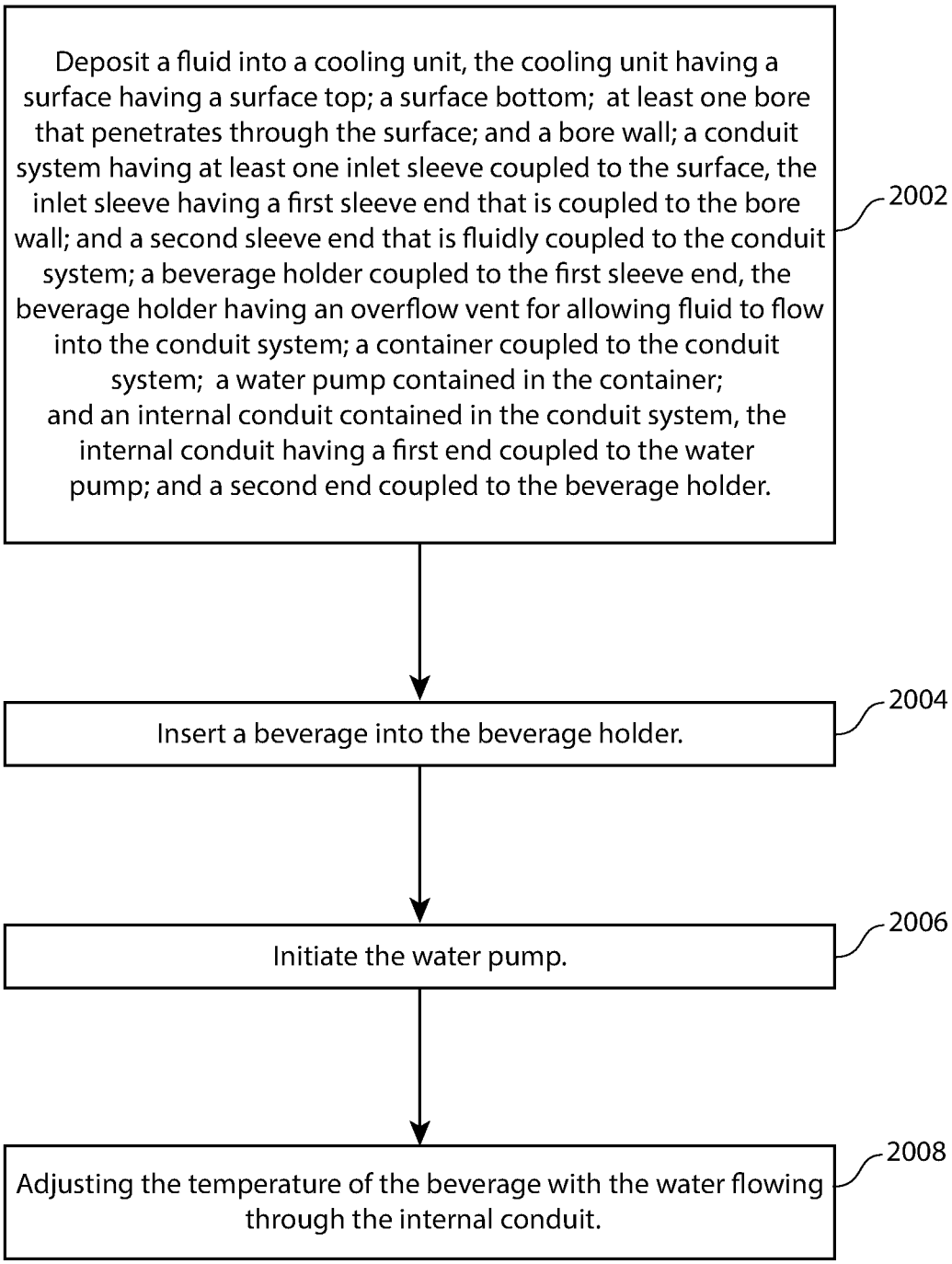
FIG. 20 is a flow chart of the method of cooling a beverage using a beverage cooling surface.

FIG. 20 is a flow chart of the method of cooling a beverage using a beverage cooling surface. The process includes depositing a fluid (such as fluid 322) into a cooling unit (such as cooling unit 100) the cooling unit (such as cooling unit 100) having a surface (such as surface 1002) having a surface top (such as surface top 1004); a surface bottom (such as surface bottom 1006); at least one bore (such as bore 1008) that penetrates through the surface (such as surface 1002); and a bore wall (such as bore wall 1010); a conduit system (such as conduit system 306) having at least one sleeve inlet (such as sleeve inlet 312) coupled to the surface (such as surface 1002), the sleeve inlet (such as sleeve inlet 312) having a first sleeve end (such as first sleeve end 314) that is coupled to the bore wall (such as bore wall 1010); and a second sleeve end (such as second sleeve end 316) that is fluidly coupled to the conduit system (such as conduit system 306); a beverage holder (such as beverage holder 1016) coupled to the first sleeve end (such as first sleeve end 314), the beverage holder (such as beverage holder 1016) having an overflow vent (such as overflow vent 1020) for allowing fluid (such as fluid 322) to flow into the conduit system (such as conduit system 306); a container (such as container 104) coupled to the conduit system (such as conduit system 306); a water pump (such as water pump 308) contained in the container (such as container 104); and an internal conduit (such as internal conduit 1012) contained in the conduit system (such as conduit system 306), the internal conduit (such as internal conduit 1012) having a first end (such as first end 1014) coupled to the pump (such as water pump 308); and a second end (such as second end 1018) coupled to the beverage holder (such as beverage holder 1014) (block 2002). Inserting a beverage (such as beverage 102) into the beverage holder (such as beverage holder 1016) (block 2004). Initiating the water pump (such as water pump 308) (block 2006). Adjusting the temperature of the beverage (such as beverage 102) with the fluid (such as fluid 322) flowing through the internal conduit (such as internal conduit 1012) (block 2008).

In one aspect, the apparatus for maintaining a constant temperature of a beverage for the duration of its consumption includes a container enclosing a volume. The container has a container floor facing the volume, a release valve, and a detachable lid positioned opposite the container floor. The detachable lid has at least one lid inlet that penetrates the detachable lid. The lid inlet has an inlet sleeve. The lid inlet has a first sleeve end that extends outside the detachable lid and a second sleeve end that extends into the container. The apparatus includes a conduit system having at least one overflow outlet fluidly coupled to the conduit system and positioned within the second sleeve end. The apparatus includes a water pump coupled to the conduit system for transferring a fluid through the conduit system.

Implementations may include one or more of the following. The container may be insulated with a temperature control material. The container may include a fluid level alert monitor. The container may include a temperature gauge. The water pump may have a minimum output of 1/200 horsepower and a maximum output of one horsepower. The inlet sleeve may include a removable cap coupled to the first sleeve end. The conduit system may be insulated with a temperature control material. The container may be coupled to an icemaker.

In one aspect, a method for maintaining a constant temperature of a beverage for the duration of its consumption includes depositing a fluid into a container enclosing a volume. The container has a container floor facing the volume, a release valve, and a detachable lid positioned opposite the container floor. The detachable lid has at least one lid inlet that penetrates the detachable lid. The lid inlet has an inlet sleeve. The inlet sleeve has a first sleeve end that extends outside the detachable lid, and a second sleeve end that extends into the container. A conduit system has at least one overflow outlet fluidly coupled to the conduit system and positioned within the second sleeve end. A water pump coupled to the conduit system for transferring a fluid through the conduit system. A beverage is inserted into the overflow outlet. The water pump is initiated. The temperature of the beverage is adjusted with the fluid flowing through the conduit system.

Implementations may include one or more of the following. The container may be insulated with a temperature control material. The container may include a fluid level alert monitor. The container may include a temperature gauge. The water pump may have a minimum output of 1/200 horsepower and a maximum output of one horsepower. The inlet sleeve may include a removable cap coupled to the first sleeve end. The conduit system may be insulated with a temperature control material. The container may be coupled to an icemaker.

In one aspect, an apparatus for maintaining a constant temperature of a beverage for the duration of its consumption includes a container enclosing a volume. The container has a container floor facing the volume and a container wall facing the volume. The container wall has a deposit door and a release valve. A detachable lid is positioned opposite the container floor. The detachable lid has at least one lid inlet that penetrates the detachable lid. The lid inlet has an inlet sleeve. The inlet sleeve has a first sleeve end coupled to the detachable lid and a second sleeve end that extends into the container. A conduit system has at least one overflow outlet fluidly coupled to the conduit system and positioned within the second sleeve end. A water pump is coupled to the conduit system for transferring a fluid through the conduit system.

Implementations may include one or more of the following. The container may be insulated with a temperature control material. The container may include a fluid level alert monitor. The container may include a temperature gauge. The water pump may have a minimum output of 1/200 horsepower and a maximum output of one horsepower. The inlet sleeve may include a removable cap coupled to the first sleeve end. The conduit system may be insulated with a temperature control material. The container may be coupled to an icemaker.

In one aspect, a method for maintaining a constant temperature of a beverage for the duration of its consumption includes depositing a fluid into a container enclosing a volume. The container has a container floor facing the volume and a container wall facing the volume. The container wall has a deposit door and a release valve. A detachable lid is positioned opposite the container floor. The detachable lid has at least one lid inlet that penetrates the detachable lid. The lid inlet has an inlet sleeve. The inlet sleeve has a first sleeve end coupled to the detachable lid and a second sleeve end that extends into the container. A conduit system has at least one overflow outlet fluidly coupled to the conduit system and positioned within the second sleeve end. A water pump is coupled to the conduit system for transferring a fluid through the conduit system inserting a beverage into the overflow outlet. The water pump is initiated. The temperature of the beverage is adjusted with the fluid flowing through the conduit system.

Implementations may include one or more of the following. The container may be insulated with a temperature control material. The container may include a fluid level alert monitor. The container may include a temperature gauge. The water pump may have a minimum output of 1/200 horsepower and a maximum output of one horsepower. The inlet sleeve may include a removable cap coupled to the first sleeve end. The conduit system may be insulated with a temperature control material.

In one aspect, the apparatus for maintaining a constant temperature of a beverage for the duration of its consumption includes a container enclosing a volume. The container has a container floor facing the volume and a release valve. A container roof is positioned opposite the container floor. The container roof has a container roof inlet that penetrates the container roof. A trough is coupled to the container roof inlet. The trough has at least one beverage mount for holding the beverage and a trough outlet. A water pump is coupled to the trough for transferring a fluid through the trough and the trough outlet.

Implementations may include one or more of the following. The container may be insulated with a temperature control material. The container may include a fluid level alert monitor. The container may include a temperature gauge. The water pump may have a minimum output of 1/200 horsepower and a maximum output of one horsepower. The trough system may be insulated with a temperature control material. The container may be coupled to an icemaker.

In one aspect, the method for maintaining a constant temperature of a beverage for the duration of its consumption includes depositing a fluid into a container enclosing a volume. The container has a container floor facing the volume and a release valve. A container roof is positioned opposite the container floor. The container roof has a container roof inlet that penetrates the container roof. A trough is coupled to the container roof inlet. The trough has at least one beverage mount for holding the beverage and a trough outlet. A water pump is coupled to the trough for transferring a fluid through the trough and the trough outlet. A beverage is inserted into the beverage mount. The water pump is initiated. The temperature of the beverage is adjusted with the fluid flowing through the trough.

Implementations may include one or more of the following. The container may be insulated with a temperature control material. The container may include a fluid level alert monitor. The container may include a temperature gauge. The water pump may have a minimum output of 1/200 horsepower and a maximum output of one horsepower. The trough system may be insulated with a temperature control material. The container may be coupled to an icemaker.

In one aspect, the apparatus for maintaining a constant temperature of a beverage for the duration of its consumption includes a surface. The surface has a surface top, a surface bottom, at least one bore that penetrates through the surface, and at least one bore wall. A conduit system has at least one inlet sleeve coupled to the surface. The inlet sleeve has a first sleeve end that is coupled to the bore wall and a second sleeve end that is fluidly coupled to the conduit system. At least one beverage holder is coupled to the first sleeve end. The beverage holder has an overflow vent for allowing fluid to flow into the conduit system. A container is coupled to the conduit system. A water pump is contained in the container. An internal conduit is contained in the conduit system. The internal conduit has a first end coupled to the pump and a second end coupled to the beverage holder.

Implementations may include one or more of the following. The conduit system may be insulated with a temperature control material. The beverage holder may be interchangeable. The water pump may have a minimum output of 1/200 horsepower and a maximum output of one horsepower. The container may include a fluid level alert monitor. The container may include a temperature gauge. The container may be insulated with a temperature control material. The container may be coupled to an icemaker.

In one aspect, the method for maintaining a constant temperature of a beverage for the duration of its consumption includes depositing a fluid into a cooling unit. The cooling unit has a surface. Surface has a surface top, a surface bottom, at least one bore that penetrates through the surface, and a bore wall. A conduit system has at least one inlet sleeve coupled to the surface. The inlet sleeve has a first sleeve end that is coupled to the bore wall and a second sleeve end that is fluidly coupled to the conduit system.

A beverage holder is coupled to the first sleeve end. The beverage holder has an overflow vent for allowing fluid to flow into the conduit system. A container is coupled to the conduit system. A water pump is contained in the container and an internal conduit contained in the conduit system. The internal conduit has a first end coupled to the pump and a second end coupled to the beverage holder. A beverage is inserted into the beverage holder. The water pump is initiated. The temperature of the beverage is adjusted with the fluid flowing through the beverage holder.

Implementations may include one or more of the following. The container may be insulated with a temperature control material. The container may include a fluid level alert monitor. The container may include a temperature gauge. The water pump may have a minimum output of 1/200 horsepower and a maximum output of one horsepower. The conduit system may be insulated with a temperature control material. The container may be coupled to an icemaker.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for maintaining a constant temperature of a beverage for the duration of its consumption, the apparatus comprising:

a container enclosing a volume, the container having:

a container floor facing the volume;

a release valve; and a detachable lid positioned opposite the container floor, the detachable lid having:

at least one lid inlet that penetrates the detachable lid, the lid inlet having:

an inlet sleeve having:

a first sleeve end that extends outside the detachable lid; and a second sleeve end that extends into the container;

a conduit system having at least one overflow outlet fluidly coupled to the conduit system and positioned within the second sleeve end; and a water pump coupled to the conduit system for transferring a fluid through the conduit system.

2. The apparatus of claim 1 wherein the container is insulated with a temperature control material.

3. The apparatus of claim 1 wherein the container includes a fluid level alert monitor.

4. The apparatus of claim 1 wherein the container includes a temperature gauge.

5. The apparatus of claim 1 wherein the water pump has a minimum output of 1/200 horsepower and a maximum output of one horsepower.

6. The apparatus of claim 1 wherein the inlet sleeve includes a removable cap coupled to the first sleeve end.

7. The apparatus of claim 1 wherein the conduit system is insulated with a temperature control material.

8. The apparatus of claim 1 wherein the container is coupled to an icemaker.

9. A method for maintaining a constant temperature of a beverage for the duration of its consumption, the method comprising:

depositing a fluid into a container enclosing a volume, the container having:

a container floor facing the volume;

a release valve; and a detachable lid positioned opposite the container floor, the detachable lid having: at least one lid inlet that penetrates the detachable lid, the lid inlet having: an inlet sleeve having:

a first sleeve end that extends outside the detachable lid; and a second sleeve end that extends into the container;

a conduit system having at least one overflow outlet fluidly coupled to the conduit system and positioned within the second sleeve end; and a water pump coupled to the conduit system for transferring a fluid through the conduit system;

inserting a beverage into the overflow outlet;

initiating the water pump; and adjusting the temperature of the beverage with the fluid flowing through the conduit system.

10. The method of claim 9 wherein the container is insulated with a temperature control material.

11. The method of claim 9 wherein the container includes a fluid level alert monitor.

12. The method of claim 9 wherein the container includes a temperature gauge.

13. The method of claim 9 wherein the water pump has a minimum output of 1/200 horsepower and a maximum output of one horsepower.

14. The method of claim 9 wherein the inlet sleeve includes a removable cap coupled to the first sleeve end.

15. The method of claim 9 wherein conduit system is insulated with a temperature control material.

16. The method of claim 9 wherein the container is coupled to an icemaker.

* * * * *